US006722420B2

(12) United States Patent
Walther et al.

(10) Patent No.: US 6,722,420 B2
(45) Date of Patent: Apr. 20, 2004

(54) INTERNALLY FINNED HEAT TRANSFER TUBE WITH STAGGERED FINS OF VARYING HEIGHT

(75) Inventors: Christoph Walther, Ulm (DE); Rolf Wamsler, Ulm (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 10/236,692

(22) Filed: Sep. 6, 2002

(65) Prior Publication Data

US 2003/0006031 A1 Jan. 9, 2003

Related U.S. Application Data

(62) Division of application No. 09/932,412, filed on Aug. 17, 2001, now Pat. No. 6,631,758.

(30) Foreign Application Priority Data

Aug. 25, 2000 (DE) ..... 100 41 919

(51) Int. Cl.[7] ..... F28F 13/18; F28F 1/14
(52) U.S. Cl. ..... 165/133; 165/184
(58) Field of Search ..... 165/133, 184, 165/109.1, 146; 29/890.049, 890.045

(56) References Cited

U.S. PATENT DOCUMENTS 4,715,436 A 12/1987 Takahashi et al. ..... 165/133
5,332,034 A 7/1994 Chiang et al.
5,704,424 A * 1/1998 Kohno et al. ..... 165/184
5,992,513 A * 11/1999 Suzuki et al. ..... 165/133
6,018,963 A * 2/2000 Itoh et al. ..... 165/133
6,026,892 A * 2/2000 Kim et al. ..... 165/133

FOREIGN PATENT DOCUMENTS

DE 196 28 280 1/1997
DE 196 12 470 10/1997
JP 401314898 A * 12/1989 ..... 165/184
JP 04/158193 6/1992
JP 04158193 A * 6/1992 ..... 165/184
JP 410238984 A * 9/1998 ..... 165/184
JP 11108579 * 4/1999 ..... 165/184
JP 2000205781 A * 7/2000

* cited by examiner

*Primary Examiner*—Henry Bennett
*Assistant Examiner*—Tho V Duong
(74) *Attorney, Agent, or Firm*—Flynn, Thiel, Boutell & Tanis, P.C.

(57) ABSTRACT

A heat transfer tube with a finned inner surface is divided into at least two zones ($Z_1$ to $Z_m$) in a peripheral direction. The fins extend at an angle of inclination α with respect to the longitudinal axis of the tube, are arranged in the individual zones ($Z_1$ to $Z_m$) in any desired periodic combination and sequence of at least two fin heights ($H_1$ to $H_n$, $H_1>H_2>\ldots>H_n$). Adjacent zones border thereby on one another so that the fin sequence is staggered for at least one fin in longitudinal direction of the tube. Modifications include the finned inner surface being divided into groups of zones, in which the angle of inclination of the fins is uniform, however, varies between adjacent groups.

33 Claims, 5 Drawing Sheets

INTERNALLY FINNED HEAT TRANSFER TUBE WITH STAGGERED FINS OF VARYING HEIGHT

CROSS-REFERENCE TO RELATED APPLICATION

This application is a divisional of application Ser. No. 09/932,412, filed Aug. 17, 2001, now U.S. Pat. No. 6,631, 758 issued Oct. 14, 2003.

FIELD OF THE INVENTION

The invention relates to a heat transfer tube having an inner surface structure. The heat transfer tube is suited in particular for the evaporation of liquids from pure materials or mixtures on the inside of the tube. However, it also offers advantages for the condensation of vapors.

BACKGROUND OF THE INVENTION

A world-wide competition in the field of heat exchangers, for example fin-tube heat exchangers (compare FIG. 1) for air-conditioning and refrigeration, demands high-performance heat transfer tubes, which are produced using little material (thus resulting in a low weight of the tube) and inexpensively in few tube forming steps. The heat transfer tubes are inserted into fin-tube heat exchangers, which can often be reversed between evaporation and condensation, and the tubes are thereby installed mostly horizontally into the fin-tube heat exchangers.

The state of the art includes a heat transfer tube according to:

U.S. Pat. No. 5,332,034, in which during two successively occurring roll embossing steps fins of a uniform height are first roll embossed onto a strip, and during a second step notches are formed into the fins. The material displaced from the fins is thereby moved laterally of the fins into the troughs. The two-step fin forming process demands several embossing tools, which are arranged in series, and thus is less economical. In addition this two-step fin forming process does not achieve a reduction of the weight of the tube in spite of the forming of the notches. The notches in adjacent fins are aligned so that a second predestined flow direction in direction of the aligned notches results near the wall in addition to the troughs, which extend parallel to and between the fins. This second preferred direction serves indeed the transverse exchange between the troughs of the first-mentioned preferred direction, the additional creation of turbulence and the increase of the evaporation performance. However, on the other hand the existence of a second preferred direction makes the desired formation of a spiral flow in the area near the wall more difficult.

DE-A-196 12 470, in which on the inner surface parallel and alternating (or also intersecting one another) high and low fins with notches additionally cut into the fins are formed. The notches of adjacent fins are here also aligned.

DE-A-196 28 280, in which in peripheral direction of the tube the alignment of the fins is alternated in sections between two different directions. A spiral flow cannot form here due to the missing preferred direction and in contrast to the helix-shaped structures. This form of the structuring of the inner surface has proven to be little suited during evaporation since clearly lower evaporation performances are achieved than with tubes having a surface which provides a clear preferred direction for the flow near the wall. Whereas during condensation this type of surface structuring has proven to be advantageous.

JP-A 4/158 193, in which in peripheral direction of the tube a differentiation is made in sections between areas of low and high fin heights. Of course, in addition to the first preferred direction in direction of the aligned fin elements a second one extending in longitudinal direction of the tube beyond the small fins is constructed, which very negatively influences in particular the evaporation performance since the flowing fluid is no longer necessarily forced into a spiral flow wetting also the upper half of the tube, but simply flows off in axial direction along the sections of lower fin height and above and beyond these small elements.

SUMMARY OF THE INVENTION

The purpose of the invention is to provide a heat transfer tube having an inner surface structure which combines the advantages of an evaporation performance, which is good or improved in comparison to the state of the art, and simultaneously has a reduced tube weight compared to the state of the art, and a reduced production expense effected by a reduction in the number of roll embossing steps.

The purpose is attained according to the invention in heat transfer tubes by the fins of each individual zone ($Z_1$ to $Z_m$) being arranged in longitudinal direction of the tube in any desired periodic combination and sequence of at least two fin heights ($H_1$ to $H_n$, $H_1>H_2>\ldots>H_n$) and extending at an angle of inclination with respect to the longitudinal axis of the tube, whereby adjacent zones ($Z_1$ to $Z_m$) border one another so that at the transition of two zones the fin sequence is staggered with respect to one another for at least one fin in longitudinal direction of the tube.

This results in the following advantages of the invention:

(1) Due to the alternating change between high and low fins in their longitudinal direction the possibility of a transverse exchange between the channels is offered over the fins of low height with a corresponding additional creation of a turbulence. However, the staggered arrangement of the fins of low height avoids a second and interfering preferred direction similar to the aligned arrangement of the notches disclosed in U.S. Pat. No. 5,332,034.

(2) A clear preferred direction of the flow near the wall exists precisely so that with the thus forced spiral flow a complete wetting of the entire tube circumference and especially of the upper half sections of the inner tube surface, is achieved. The wetting is needed for a good and improved evaporation performance. Whereas in the case of structures without a uniform preferred direction, as disclosed in DE-A-196 28 280, a drying of the upper sections of the tube circumference occurs and consequently a significant reduction of the evaporation performance.

(3) In contrast to the subsequent forming of the notches in a second embossing step, this structure can be created in one single embossing step so that, instead of the displacement of material out of the fins into the troughs, indeed a material savings and a weight reduction is achieved and in addition a reduction of the production expense through a reduction in the number of fin forming steps.

(4) Structures with an angle of inclination of the fins varying in zones offer mainly, with respect to the technique of shaping, important advantages since possibly occurring lateral forces, which are caused by the grooves and fins extending at an incline with respect to the direction of the strip, can be at least partially compensated for in the fin forming process, and the guiding of the strip is in this manner made easier. The heat transfer performance can be further increased by the edges, sharp-edge or also rounded projections and recesses, which edges are according to the invention provided additionally in the surface structure through the various heights, base widths, and cross-sectional shapes of the fins of varying height.

Through the various heights, base widths, and cross-sectional shapes of the fins of varying height additional edges, sharp-edge or also rounded projections and recesses are created in the surface structure and in the lateral flanks of the near wall troughs, which edges, projections and recesses serve to create a further turbulence and, in particular in the case of mixtures, to prevent the possible formation of temperature and concentration boundary layers and yet be available as additional nucleation sites. (Advantage over DE-A-196 12 470).

The manufacture of the heat transfer tube of the invention is based, for example, on the method described in greater detail hereinafter. Copper or a copper alloy are usually used as the material for the heat transfer tubes, however, the present invention is not limited in this manner. Rather any type of metal can be used, for example aluminum. A metallic flat strip is initially subjected to a one-step embossing step by being guided between an emboss roll with a surface design complementary to the structure of the invention and a support roll. One side of the flat strip receives thereby the structure of the invention, whereas the second side remains smooth or has also a structuring here not described in detail. Merely the strip edge areas of the first side, which edge areas are used for the subsequent welding, may possibly be differently structured or may even remain non-structured. The structured flat strip is after the embossing step formed into an open seam tube, is seam welded, and the tube, if necessary, receives in addition during a final drawing process the desired outside diameter. A possible influence on the heat-transfer ability of the heat transfer tube of the invention by the strip edge area, which surrounds the welding seam and which may be differently structured or remains even non-structured, is unimportant and can be neglected.

In the preferred embodiment of an emboss roll for the manufacture of the heat transfer tubes of the invention, the modular design of the emboss roll out of disks or rings is a further advantage of the invention. The design enables according to the modular concept a quick set-up and evaluation of many structure variations within the scope of a test scheme and a quick adaptation of the surface structuring to new fluids and changed operating conditions through a change of the number, form and (groove) geometry of the disks and rings or through the exchange of individual disks/rings.

BRIEF DESCRIPTION OF THE DRAWINGS

The invention will be discussed in greater detail in connection with the following exemplary embodiments.

In the drawings.

DETAILED DESCRIPTION

Figure 1:
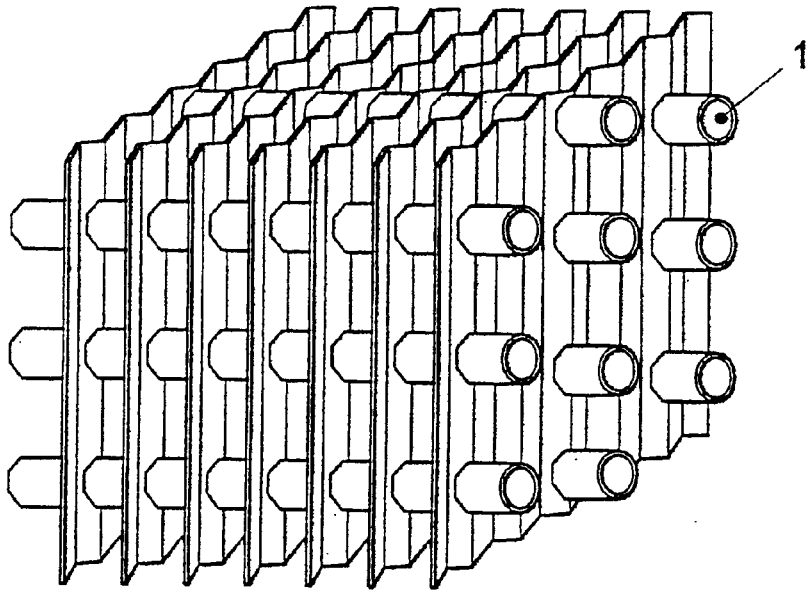
FIG. 1 illustrates a fin-tube heat exchanger according to the state of the art.

FIG. 1 illustrates a fin-tube heat exchanger according to the state of the art with horizontally arranged heat transfer tubes 1 having fins not identified in detail.

Figure 2:
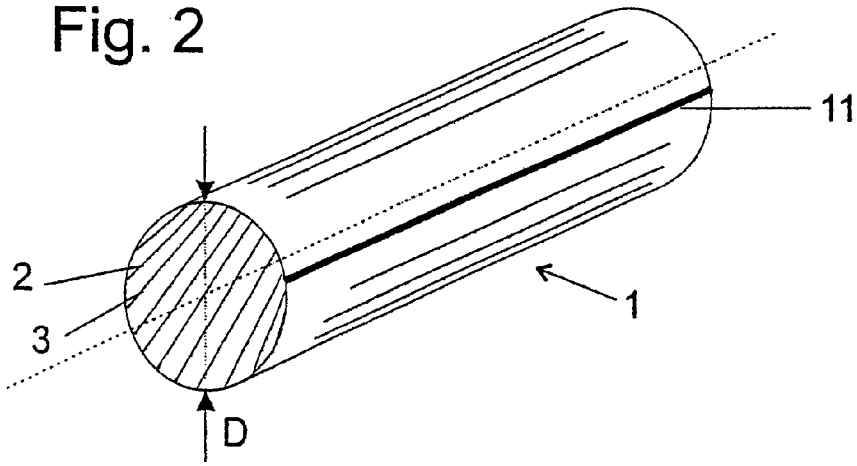
FIG. 2 is a perspective drawing of a section of an internally finned heat transfer tube.

FIG. 2 illustrates a longitudinal section of a heat transfer tube 1 having an outer diameter D, which tube 1 is welded and, therefore, has a longitudinal seam 11. The heat transfer tube has a smooth outer surface and a structured inner surface.

Figure 3:
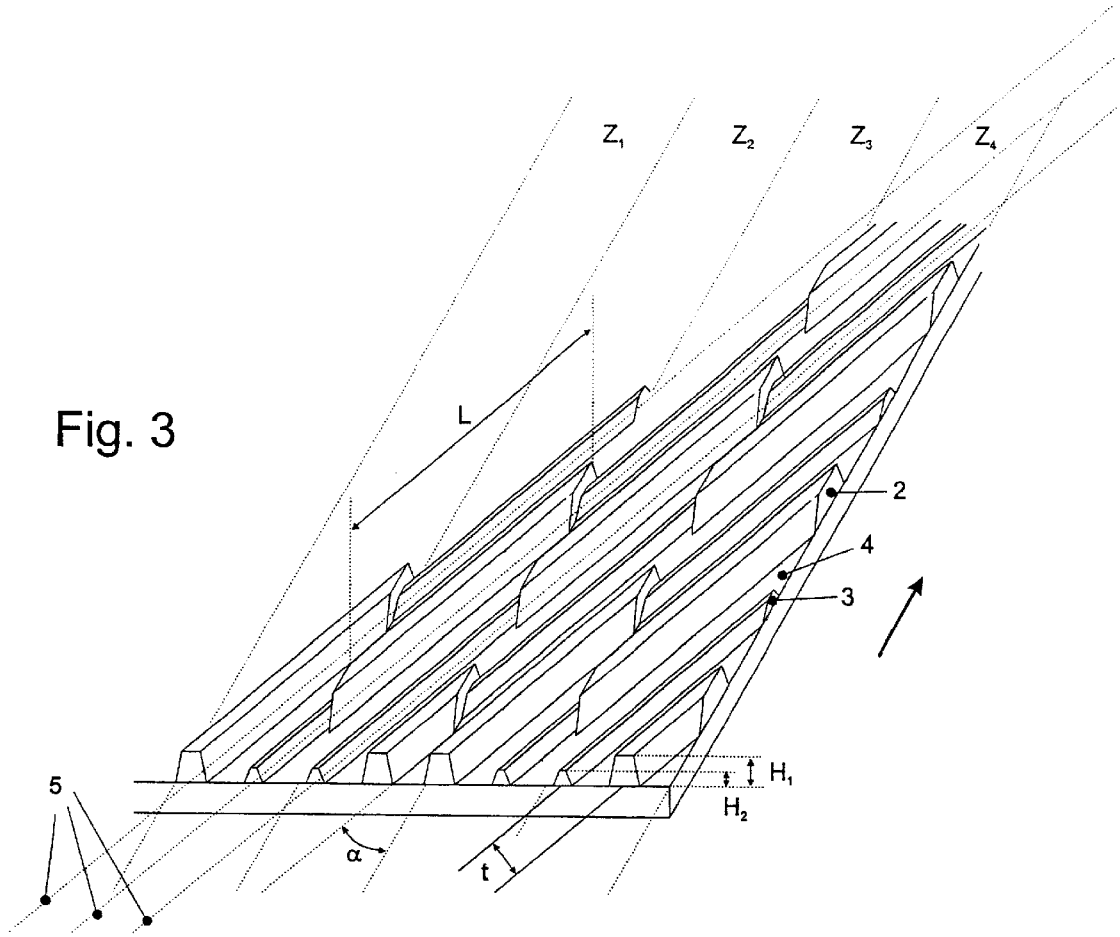
FIG. 3 is a schematic top view of an inventive heat transfer tube with an opened-up, finned inner surface.

FIG. 3 schematically illustrates a top view of the opened-up inner surface of such a finned heat transfer tube 1. The inner surface is divided into four zones ($Z_1$ to $Z_4$) extending in longitudinal direction of the tube (see the direction of the arrow). High fins 2 (fin height $H_1$) and low fins 3 (fin height $H_2$) are alternatingly (in longitudinal direction of the tube) formed into each zone ($Z_1$ to $Z_4$), which fins are separated by grooves 4. The fins 2, 3, and the grooves 4, extend at an inclination with respect to the longitudinal direction of the tube, namely the centerlines 5 of the fins 2, 3 form with the longitudinal direction of the tube an angle of inclination $\alpha$. Adjacent zones ($Z_1$ to $Z_4$) are staggered so that a respective high fin 2 and a low fin 3 abut at the borders of the zones ($Z_1$ to $Z_4$). The fin length within one zone, measured along the centerlines 5 of the fins 2, 3, is identified by the letter L.

Figure 4:
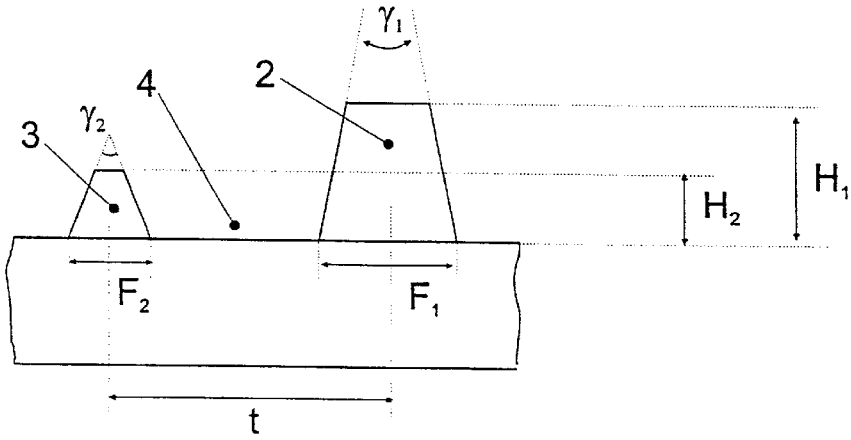
FIG. 4 illustrates in an enlarged scale a cross section perpendicular with respect to the fin centerlines of one high and one low fin according to FIG. 3.

FIG. 4 illustrates in detail the fin pitch t (distance from fin center to fin center, measured perpendicularly with respect to the fin centerlines 5), the fin apex angle $\gamma_1$ or $\gamma_2$, the fin height $H_1$ or $H_2$, and the fin base widths $F_1$, or $F_2$. The apex angles $\gamma_1$, $\gamma_2$ and the base widths $F_1$, $F_2$ are also measured in a cross-sectional. plane perpendicular with respect to the fin centerlines 5.

Figure 5:
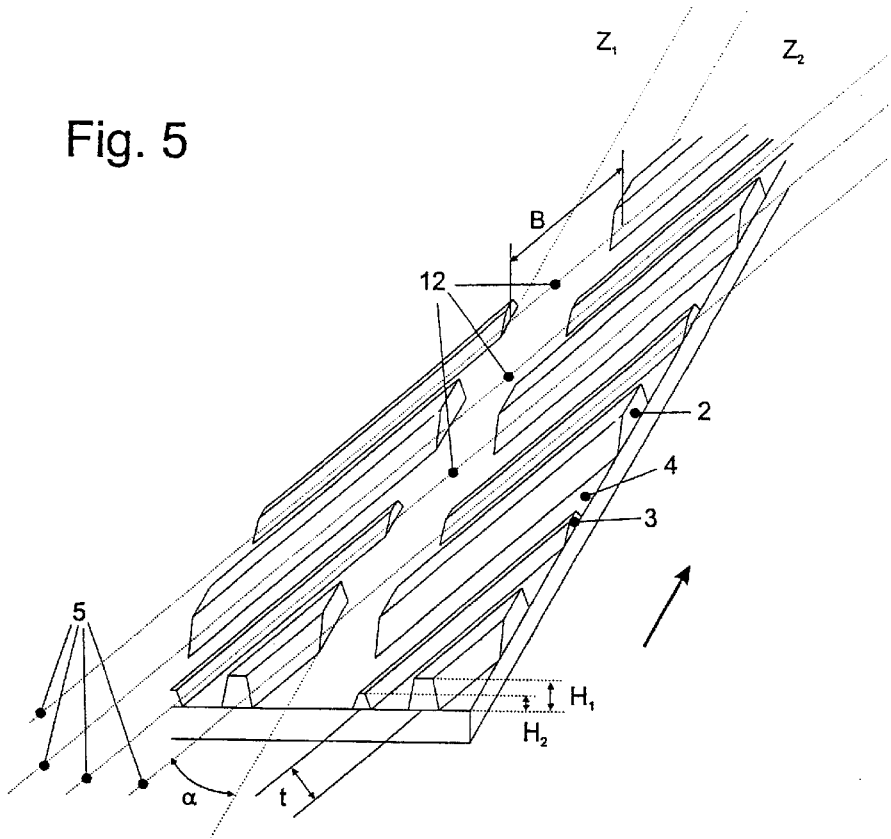
FIG. 5 is a schematic top view of an inventive heat transfer tube analogous to FIG. 3, in which the high and the low fins are each separated from one another by a gap, FIG. 6 schematically illustrates the design of an emboss roll for the manufacture of the inventive heat transfer tube.

FIG. 5 illustrates schematically and analogously to FIG. 3 a top view of the opened-up inner surface of a finned heat transfer tube 1, in which high and low fins are separated from one another at the transition of adjacent zones each by a gap 12 having a length B (measured along the extended centerlines 5 of the fins 2, 3).

Figure 6:
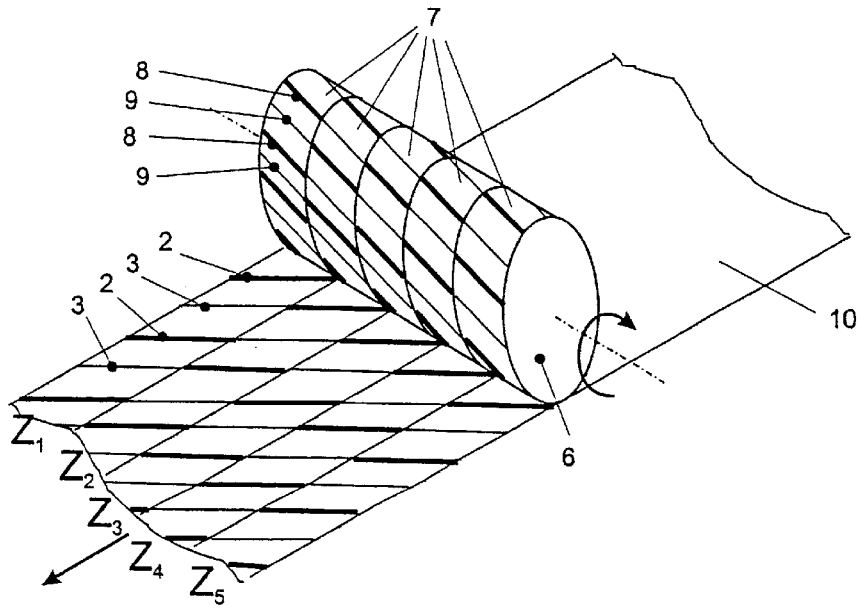

FIG. 6 schematically illustrates the design of an emboss roll 6 for the manufacture of the heat transfer tube 1.

The roll 6 is assembled of various disks 7, which are staggered in peripheral direction. Deep and less deep grooves 8, 9 are alternatingly cut into the individual disks 7, which grooves 8, 9 produce during rolling of the roll 6 on the sheet-metal strip 10 in one embossing operation the high fins 2 and the lower fins 3 in the individual zones $Z_1$ to $Z_5$. The sheet-metal strip 10 is after the structuring has been completed formed into an open seam tube and is thereafter longitudinally welded to produce the welding seam 11.

FIGS. 7 to 10 illustrate in black and white further embodiments of the invention, whereby the fin tips/fin flanks are white and the base of the grooves 4 extending between the fins 2, 3 is black.

Figure 7:
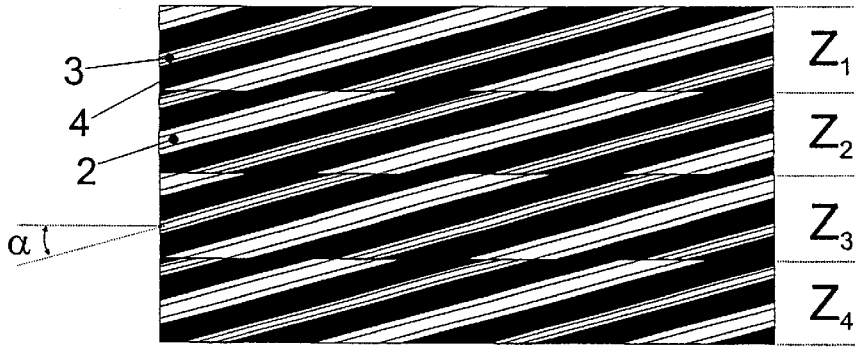
FIG. 7 is a black-white illustration of a top view of an inventive heat transfer tube with an opened-up inner surface, which is divided into four zones.
Figure 8:
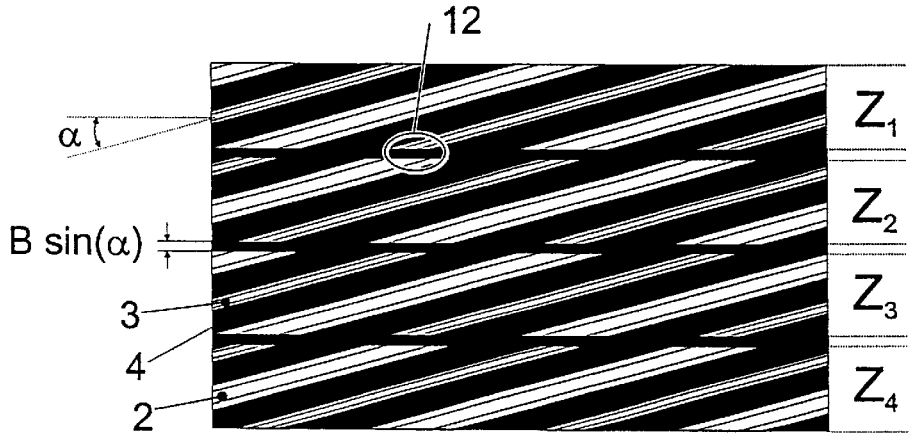
FIG. 8 illustrates an inner surface according to FIG. 7, in which the high and the low fins are each separated by a gap.

FIGS. 7 and 8 each illustrate an embodiment having four zones ($Z_1$ to $Z_4$), whereby FIG. 8 is different due to the additional arrangement of gaps 12 having the length B between the high fins 2 and the low fins 3. These relationships are made clear by the illustration according to FIG. 5.

Figure 9:
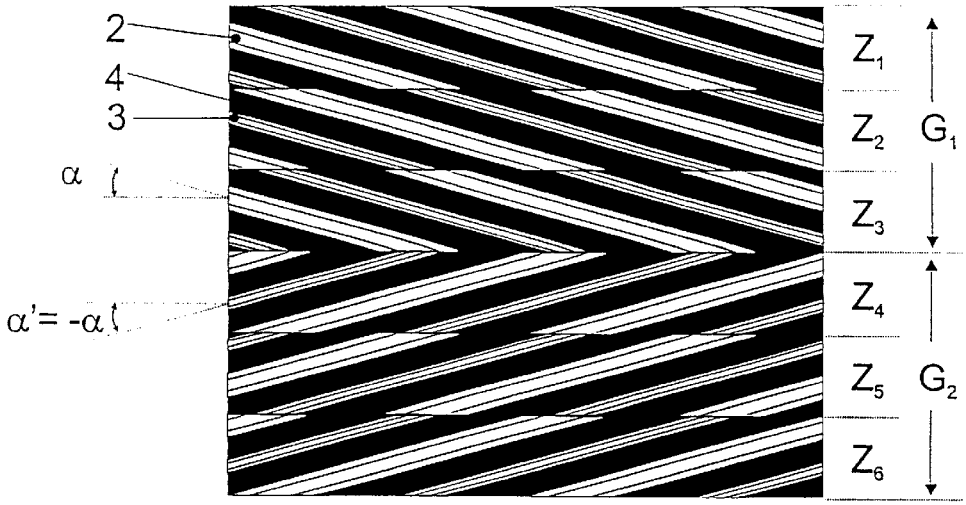
FIG. 9 is a black-white illustration of a top view of a further inventive heat transfer tube with an opened-up inner surface, which is divided into six zones, whereby the fins have positive and negative angles of inclination.

The inner surface of the heat transfer tube 1 according to FIG. 9 is divided into 6 zones ($Z_1$ to $Z_6$) The fins 2, 3 extend in the group $G_1$ consisting of three zones ($Z_1$ to $Z_3$) at the angle of inclination $\alpha$, in the group $G_2$ consisting of three zones ($Z_4$ to $Z_6$) at the (negative) angle $\alpha'=-\alpha$, which angle is symmetrically opposite with respect to the boundary line between adjacent groups.

Figure 10:
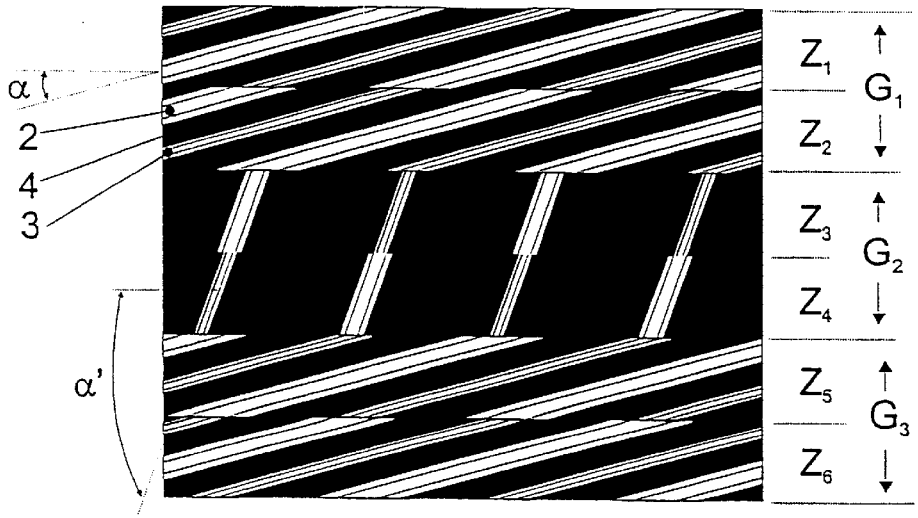
FIG. 10 is a black-white illustration of a top view of a further inventive heat transfer tube with an opened-up inner surface, which is divided into six zones, whereby the fins have a different angle of inclination in the two center zones than the fins in the two respective edge zones.

The inner surface of the heat transfer tube 1 according to FIG. 10 is also divided into 6 zones ($Z_1$ to $Z_6$). The fins 2, 3 extend in the groups $G_1$ and $G_3$ consisting of zones $Z_1/Z_2$ and $Z_5/Z_6$ at the angle of inclination $\alpha$, in the group $G_2$ consisting of zones $Z_3/Z_4$ at a different angle of inclination $|\alpha'|\neq|\alpha|$.

The fin heights and shapes can have different variations for the respective zones or groups of the transfer tube 1. One example is illustrated in FIG. 4. In some cases the transfer tube 1 can have in each zone ($Z_1$ to $Z_m$) in a periodic repetition exactly one fin with the fin height $H_i$ (i=1 to n) followed in each case exactly by one fin with the fin height $H_j$ (j=1 to n, $j\neq i$, $H_j\neq H_i$) and possibly further fins with the heights $H_k$ (k=1 to n, $k\neq i$, j, $H_k\neq H_i$, $H_j$) in a longitudinal direction of the tube.

In some cases, transfer tube 1 can have in each zone ($Z_1$ to $Z_m$) in a periodic repetition two or more fins with the fin height $H_i$ (i=1 to n) each followed exactly by one fin with the fin height $H_j$ (j=1 to n, $j\neq i$, $H_j\neq H_i$) and possibly further fins with the heights $H_k$ (k=1 to n, $k\neq i$, j, $H_k\neq H_i$, $H_j$) in a longitudinal direction of the tube.

In another case, the heat transfer tube can have in each zone ($Z_1$ to $Z_m$) in a periodic repetition exactly one fin with the fin height $H_i$ (i=1 to n) followed by two or more fins with the fin height $H_j$ (j=1 to n, $j\neq i$, $H_j\neq H_i$) and possibly further fins with heights $H_k$ (k=1 to n, $k\neq i$, j, $H_k\neq H_i$, $H_j$) in a longitudinal direction of the tube.

In another embodiment, the heat transfer tube 1 can have in each zone ($Z_1$ to $Z_m$) in a periodic repetition two or more fins with the fin height $H_i$ (i=1 to n) followed by two or more fins with the fin height $H_j$ (j=1 to n, $j\neq i$, $H_j\neq H_i$) and possibly further fins with the heights $H_k$ (k=1 to n, $k\neq i$, j, $H_k\neq H_i$, $H_j$) in a longitudinal direction of the tube.

In some cases, the heat transfer tube 1 can have an outer tube diameter of D=3 mm to 20 mm with an angle of inclination of $\alpha$=5° to 85°. The largest fin height $H_1$ can be from 0.05 mm to 0.5 mm and the fin length per zone L can be from 0.5 mm to 15 mm.

In another embodiment, the heat transfer tube 1 can have an outer tube diameter D from 6 mm to 12.7 mm, an angle of inclination $\alpha$ from 10° to 40°, a largest fin height $H_1$ from 0.1 mm to 0.3 mm and a fin length per zone L from 0.5 mm to 10 mm.

In some cases, the heat transfer tube 1 has fin heights $H_j$ (j=2 to n) that, when compared with the largest fin height $H_1$, define a ratio $H_j/H_1$ from 0.1 to 0.9.

In other cases, the heat transfer tube 1 has a fin height $H_2$ that, when compared with the largest fin height $H_1$, defines a ratio $H_2/H_1$ from 0.4 to 0.6.

The heat transfer tube 1 can have fins with a fin pitch t from 0.1 mm to 0.8 mm and an apex angle $\gamma_1$ to $\gamma_n$ from 10° to 60°. In other cases, the heat transfer tube can have a fin pitch from 0.2 mm to 0.6 mm and an apex angle $\gamma_1$ to $\gamma_n$ from 20° to 50°.

In some embodiments the cross sections of the fins are geometrically similar. In other embodiments, the cross sections of the fins are geometrically different.

Numerical Example:

For the manufacture of a heat transfer tube 1 with an outer diameter of D=7 mm, the emboss roll 6 is designed with 19 disks 7 having a diameter of 33 mm and a thickness of 1.2 mm so that the resulting structuring of the inner surface of the heat transfer tube 1 corresponding to FIG. 2 consists of nineteen (19) 1.2 mm wide zones prior to the final drawing process, in which zones alternating high and lower fins 2, 3 (alternating in longitudinal direction of the strip 10) extend at an angle of $\alpha$=14.3° with respect to the longitudinal direction of the flat strip 10. In this embodiment, each zone contains, in a cross section in peripheral direction, exactly one high and one lower fin 2, 3 so that altogether in peripheral direction nineteen (19) high fins 2 and nineteen (19) lower fins 3 are created. The fin heights are $H_1$=0.14 mm and $H_2$=0.07 mm, the apex angle $\gamma$=45°, the lengths of the fins L=4.86 mm and the pitch (the distance between a high and a low fin measured perpendicularly with respect to the fin) is t=0.58 mm. To effect a staggering of the zones or respectively a staggering of the disks 7 of the emboss roll 6 a twist angle between adjacent disks of 90° is set.

What is claimed is:

1. A heat transfer tube having a finned inner surface, which is divided into at least two groups ($G_1$ to $G_p$) of zones ($Z_1$ to $Z_m$) in peripheral direction, whereby each group includes at least two zones, and the angle of inclination of the fins in the zones of one group is uniform, however, the angle of inclination varies between the adjacent groups such that when counting starting with one group $G_1$ in groups with an uneven number a different angle of inclination of the fins exists than the angle of inclination in groups with an even number, wherein the fins in the individual zones ($Z_1$ to $Z_m$) are arranged in any desired periodic combination and sequence of at least two fin heights ($H_1$ to $H_n$, $H_1>H_2>\ldots>H_n$), wherein adjacent zones ($Z_1$ to $Z_m$) of one group border one another so that at the transition of the two adjacent ones of the zones of one group the fin height changes for at least one of the fins in a longitudinal direction of the tube.

2. The heat transfer tube according to claim 1, wherein in each of the zones ($Z_1$ to $Z_m$) in the periodic sequence exactly one fin with the fin height $H_i$ (i=1 to n) is followed by one fin with the fin height $H_j$ (j=1 to n, $j\neq i$, $H_j\neq H_i$) and further ones of the fins with the heights $H_k$ (k=1 to n, $k\neq i$, j, $H_k\neq H_i$, $H_j$).

3. The heat transfer tube according to claim 1, wherein in each of the zones ($Z_1$ to $Z_m$) in the periodic sequence two or more of the fins with the fin height $H_i$ (i=1 to n) are each followed exactly by one of the fins with the fin height $H_j$ (j=1 to n, $j\neq i$, $H_j\neq H_i$) and further one of the fins with the heights $H_k$ (k=1 to n, $k\neq i$, j, $H_k\neq H_i$, $H_j$).

4. The heat transfer tube according to claim 1, wherein in each of the zones ($Z_1$ to $Z_m$) in the periodic sequence exactly one fin with the fin height $H_i$ (i=1 to n) is followed by two or more fins with the fin height $H_j$ (j=1 to n, $j\neq i$, $H_j\neq H_i$).

5. The heat transfer tube according to claim 1, wherein in each of the zones ($Z_1$ to $Z_m$) in the periodic sequence two or more fins with the fin height $H_i$ (i=1 to n) are followed by two or more fins with the fin height $H_j$ (j=1 to n, $j\neq i$, $H_j\neq H_i$).

6. The heat transfer tube according to claim 1, wherein an outer tube diameter D is from 3 mm to 20 mm, the angle of inclination $\alpha$ is from 5 ° to 85°, the largest fin height $H_1$ is from 0.05 mm to 0.5 mm and the fin length per zone L is from 0.5 mm to 15 mm.

7. The heat transfer tube according to claim 6, wherein an outer tube diameter =D is from 6 mm to 12.7 mm, the angle of inclination $\alpha$=is from 10° to 40°, the largest fin height $H_1$ is from 0.1 mm to 0.3 mm and the fin length per zone L is from 0.5 mm to 10 mm.

8. The heat transfer tube according to claim 1, wherein the fin heights $H_j$ (j=2 to n) compared with the largest fin height $H_1$, define a ratio $H_j/H_1$ from 0.1 to 0.9.

9. The heat transfer tube according to claim 1, wherein the fin height $H_2$ compared with the largest fin height $H_1$, defines a ratio $H_2/H_1$ from 0.4 to 0.6.

10. The heat transfer tube according to claim 6, wherein the fin height $H_2$ compared with the largest fin height $H_1$, defines a ratio $H_2/H_1$ from 0.4 to 0.6.

11. The heat transfer tube according to claim 7, wherein the fin height $H_2$ compared with the largest fin height $H_1$, defines a ratio $H_2/H_1$ from 0.2 to 0.7.

12. The heat transfer tube according to claim 1, wherein the fins have a fin pitch =t from 0.1 mm to 0.8 mm and an apex angle $\gamma_1$ to $\gamma_n$ from 10° to 60°.

13. The heat transfer tube according to claim 1, wherein the fins have a fin pitch from 0.2 mm to 0.6 mm and an apex angle $\gamma_1$ to $\gamma_n$ from 20° to 50°.

14. The heat transfer tube according to claim 1, wherein cross sections of the fins are geometrically similar.

15. The heat transfer tube according to claim 1, wherein cross sections of the fins are geometrically different.

16. A heat transfer tube having a finned inner surface, which is divided in peripheral direction into at least two groups ($G_1$ to $G_p$) of zones ($Z_1$ to $Z_m$), whereby each group includes at least two zones and the angle of inclination of the fins is uniform in each of the zones of one group, however, between the adjacent groups such that when counting starting with one group $G_1$ in groups with uneven numbers the angle of inclination of the fins exists, in groups with an even number the angle of inclination of the fins is symmetrically opposite with respect to a boundary line between the adjacent groups, wherein the fins in the individual zones ($Z_1$ to $Z_m$) are arranged in any desired periodic combination and sequence of at least two fin heights ($H_1$ to $H_n$, $H_1>H_2>\ldots>H_n$), wherein adjacent zones ($Z_1$ to $Z_m$) of one group border one another so that at the transition of two adjacent ones of the zones of one group the fin height changes for at least one of the fins in a longitudinal direction of the tube.

17. The heat transfer tube according to claim 16, wherein in each of the zones ($Z_1$ to $Z_m$) in the periodic sequence exactly one fin with the fin height $H_i$ (i=1 to n) is followed exactly by one fin with the fin height $H_j$ (j=1 to n, j $\neq$i, $H_j \neq H_i$).

18. The heat transfer tube according to claim 16, wherein in each of the zones ($Z_1$ to $Z_m$) in the periodic sequence two or more of the fins with the fin height $H_i$ (i=1 to n) are each followed exactly by one of the fins with the fin height $H_j$ (j=1 to n, j$\neq$i, $H_j \neq H_i$).

19. The heat transfer tube according to claim 16, wherein in each of the zones ($Z_1$ to $Z_m$) in the periodic sequence exactly one fin with the fin height $H_i$ (i=1 to n) is followed by two or more fins with the fin height $H_j$ (j=1 to n, j$\neq$i, $H_j \neq H_i$).

20. The heat transfer tube according to claim 16, wherein in each of the zones ($Z_1$ to $Z_m$) in the periodic sequence two or more of the fins with the fin height $H_i$ (i=1 to n) are followed by two or more of the fins with the fin height $H_j$ (j=1 to n, j·i, $H_j \neq H_i$).

21. The heat transfer tube according to claim 16, wherein with an outer tube diameter D from 3 mm to 20 mm, the angle of inclination $\alpha$ is from 5° to 85°, the largest fin height $H_1$ is from 0.05 mm to 0.5 mm and the fin length per zone L is from 0.5 mm to 15 mm.

22. The heat transfer tube according to claim 21, wherein an outer tube diameter D is from 6 mm to 12.7 mm, the angle of inclination $\alpha$ is from 10° to 40°, the largest fin height $H_1$ is from 0.1 mm to 0.3 mm and the fin length per zone L is from 0.5 mm to 10 mm.

23. The heat transfer tube according to claim 17, wherein the fin heights $H_j$ (j=2 to n), compared with the largest fin height $H_1$, define a ratio $H_j/H_1$=from 0.1 to 0.9.

24. The heat transfer tube according to claim 16, wherein the fin height $H_2$ compared with the largest fin height $H_1$, defines a ratio $H_2/H_1$ from 0.2 to 0.7.

25. The heat transfer tube according to claim 16, wherein the fin height $H_2$ compared with the largest fin height $H_1$, defines a ratio $H_2/H_1$ from 0.4 to 0.6.

26. The heat transfer tube according to claim 21, wherein the fin height $H_2$ compared with the largest fin height $H_1$, defines a ratio $H_2/H_1$ from 0.4 to 0.6.

27. The heat transfer tube according to claim 21, wherein the fin height $H_2$ compared with the largest fin height $H_1$, defines a ratio $H_2/H_1$ from 0.2 to 0.7.

28. The heat transfer tube according to claim 27, wherein the fins have a fin pitch t from 0.1 mm to 0.8 mm and an apex angle $\gamma_1$ to $\gamma_n$ from 10° to 60°.

29. The heat transfer tube according to claim 27, wherein the fins have a fin pitch from 0.2 mm to 0.6 mm and an apex angle $\gamma_1$ to $\gamma_n$ from 20° to 50°.

30. The heat transfer tube according to claim 16, wherein cross sections of the fins are geometrically similar.

31. The heat transfer tube according to claim 16, wherein cross sections of the fins are geometrically different.

32. A heat transfer tube having an inner surface, the inner surface being divided into at least a first group and a second adjacent group, the groups being defined by a transition located therebetween and extending in a longitudinal direction along the length of the inner surface;

each of the at least first and second groups comprises at least two zones extending in a longitudinal direction along the length of the inner surface, the zones being defined by a transition located therebetween and extending in a longitudinal direction along the inner surface;

the inner surface of the tube includes a plurality of fins in each of the zones for each of the groups, at least one of said fins having a first fin height within a first one of the zones of the first group and at least one of the fins having a second different fin height within an adjacent second one of the zones of the first group, wherein the angle of inclination of the fins having a first fin height is the same as the angle of inclination of the fins having a second different fin height within the second adjacent one of the zones for the first group;

at least one of said fins having a first height within a first one of the zones of the second group and at least one of the fins having a second different fin height within an adjacent second one of the zones of the second group, wherein the angle of inclination of the fins having a first fin height is the same as the angle of inclination of the fins having a second different fin height within the second adjacent one of the zones of the second adjacent group; and wherein at the transition between the first group and the second group, the fins of the first group have a different angle of inclination than the fins of the second adjacent group.

33. The heat transfer tube according to claim 32, wherein the angle of inclination of the fins of the first group is symmetrically opposite with respect to a boundary line between the first group and the second adjacent group.

* * * * *

UNITED STATES PATENT AND TRADEMARK OFFICE

CERTIFICATE OF CORRECTION

PATENT NO. : 6,722,420 B2
DATED : April 20, 2004
INVENTOR(S) : Christopher Walther et al.

It is certified that error appears in the above-identified patent and that said Letters Patent is hereby corrected as shown below:

Column 6,
Line 56, replace “one” with -- ones --.

Column 7,
Lines 5, 6 and 20, delete “=”.
Line 62, replace “j · i” with -- j≠i --.

Column 8,
Lines 20 and 23, replace “27” with -- 22 --.

Signed and Sealed this

Twelfth Day of October, 2004

JON W. DUDAS
*Director of the United States Patent and Trademark Office*